US007885424B2

(12) United States Patent
Watanabe

(10) Patent No.: US 7,885,424 B2
(45) Date of Patent: Feb. 8, 2011

(54) AUDIO SIGNAL SUPPLY APPARATUS

(75) Inventor: Takayuki Watanabe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1102 days.

(21) Appl. No.: 11/403,506

(22) Filed: Apr. 12, 2006

(65) Prior Publication Data

US 2006/0233382 A1 Oct. 19, 2006

(30) Foreign Application Priority Data

Apr. 14, 2005 (JP) ..... 2005-117165

(51) Int. Cl.
*H04R 29/00* (2006.01)

(52) U.S. Cl. ..... 381/303; 381/89

(58) Field of Classification Search ..... 381/17–19, 381/300, 303, 307, 310, 61, 65, 77, 79–81, 381/89, 335

See application file for complete search history.

(56) References Cited

U.S. PATENT DOCUMENTS 7,519,187 B2 * 4/2009 Konagai ..... 381/98
2004/0131338 A1 7/2004 Asada et al.
2004/0151325 A1 8/2004 Hooley et al.
2006/0126878 A1 6/2006 Takumai et al.
2007/0165878 A1 * 7/2007 Konagai ..... 381/89
2007/0230724 A1 * 10/2007 Konagai et al. ..... 381/303
2008/0165979 A1 * 7/2008 Takumai ..... 381/59

FOREIGN PATENT DOCUMENTS

JP 04-351197 A 12/1992
JP 2004-363697 A 12/2004
JP 2005-064746 A 3/2005

* cited by examiner

*Primary Examiner*—Devona E Faulk
(74) *Attorney, Agent, or Firm*—Morrison & Foerster LLP

(57) ABSTRACT

An audio signal supply apparatus which can broaden a listening area in the directions of directivity axes of acoustic beams output from a speaker array and directions other than the directions of the directivity axes. A listening area is set, propagation paths to be followed by sounds output from speakers constituting the speaker array until the sounds reach the listening area are identified, propagation path information related to the propagation paths is obtained, window function information giving wide directivities covering the entire listening area to the sounds output from the speakers is identified based on the propagation path information and the listening area size, and weighting on the signal levels of audio signals to be supplied to the speakers is carried out using the window function information.

22 Claims, 8 Drawing Sheets

AUDIO SIGNAL SUPPLY APPARATUS

BACKGROUND OF THE INVENTION

1. Field of the Invention

The present invention relates to an audio signal supply apparatus that supplies audio signals to a speaker array that forms a sound field, and more particularly, to an audio signal supply apparatus that makes it possible to broaden an area where satisfactory localization of sound images can be obtained.

2. Description of the Related Art

To reproduce realistic sound in acoustic spaces such as concert halls, movie theaters, and various event halls, a speaker array comprised of a plurality of speakers (hereinafter also referred to as "speaker units") is commonly set up in the acoustic spaces. In an example illustrated in FIG. 6, nine listeners HM1 to HM9 are seated in three lines and three rows in an acoustic space RM which is rectangular in horizontal cross-section, and a speaker array 200 is placed on a front wall of the acoustic space RM. The speaker array 200 is comprised of, for example, a plurality of speakers which are two-dimensionally arranged. In the case where the speaker array 200 forms a sound field in which virtual sound images of right and left channels are localized on right and left side walls, respectively, of the acoustic space RM, delays and signal levels of audio signals which are to be supplied to the respective speakers of the speaker array 200 are adjusted as described below, for example.

Specifically, as shown in FIG. 6, it is assumed that there is a virtual image RM' of the virtual space RM, which is symmetrical to the acoustic space RM with respect to the left side wall of the acoustic space RM. In FIG. 6, HM5' denotes a virtual image of the listener HM5. A focus Ptg for left-channel audio signals is set at a point at which a straight line connecting the center of the speaker array 200 with the virtual image HM5' of the listener HM5 intersects the left side wall. As a result, left-channel virtual sound images are formed at the focus Ptg. This also applies to right-channel audio signals.

However, if the focus Ptg is set in the above described way, there is the problem that the wave front of sound waves output from the speaker array 200 and reflected on the left side wall becomes wider as the distance from the focus Ptg increases, and hence, the more distant from the focus Ptg a listener is seated, the less is satisfactory the localization of virtual sound images he/she can obtain.

To solve this problem, a variety of techniques have been conventionally proposed. An example of such techniques is disclosed in U.S. Patent Publication No. 2004/0131338 A1. As shown in FIG. 7, this publication describes that the focus Ptg is set within the virtual image HM5' so that an area where satisfactory localization of virtual sound images can be obtained (hereinafter referred to as "listening area") is formed around the listener HM5.

Also, as shown in FIG. 8, to broaden the listening area, placing a diffusion plate (RB) on a wall surface defining the acoustic space RM so as to diffuse acoustic beams (sound waves) output from the speaker array 200 has been proposed.

According to the technique disclosed in U.S. Patent Publication No. 2004/0131338 A1, localization of sound images can be improved at locations in the directions of directivity axes of acoustic beams (in FIG. 7, the direction of a straight line connecting the listeners HM1, HM5, and HM9), but cannot be improved at locations out of the directions of directivity axes of acoustic beams, such as the locations of the listeners HM3 and the listener HM7. Namely, the technique disclosed in U.S. Patent Publication No. 2004/0131338 A1 has the problem that the listening area cannot be broadened satisfactorily. This problem does not arise if the technique involving architectural measures such as the placement of a diffusion plate is adopted, but there is the problem that efforts to take such architectural measures are needed.

SUMMARY OF THE INVENTION

It is an object of the present invention to provide an audio signal supply apparatus that makes it possible to broaden a listening area not only in the directions of directivity axes of acoustic beams output from a speaker array placed in an acoustic space but also in directions other than the directions of the directivity axes without the need to take architectural measures such as placement of a diffusion plate on a wall of the acoustic space.

To attain the object, there is provided an audio signal supply apparatus comprising an area setting device that is used to specify a listening area in an acoustic space, a path identifying device that identifies propagation paths to be followed by sounds output from respective ones of a plurality of speakers constituting a speaker array until the sounds reach the listening area and obtains pieces of propagation path information respectively related to the propagation paths, and a signal processing device that identifies pieces of window function information that give such directivities as to cover the entire listening area to the sounds output from the respective ones of the plurality of speakers based on the pieces of propagation path information and a size of the listening area, wherein the signal processing device carries out weighting on respective signal levels of a plurality of audio signals branched from an externally input audio signal and corresponding in number to the plurality of speakers by using the pieces of window function information to obtain output signals that are to be supplied to the respective ones of the plurality of speakers.

With this arrangement of the present invention, when audio signals are supplied from the audio signal supply apparatus to the respective speakers constituting the speaker array, sound waves to which wide directivities covering the entire listening area set in the acoustic space by the area setting device have been given are output from the respective speakers.

Specifically, according to the present invention, without the need to take architectural measures such as placement of a diffusion plate on a wall of the acoustic space where the speaker array is placed, a listening area in the acoustic space where satisfactory localization of sound images can be obtained can be broadened not only in the directions of directivity axes of acoustic beams output from the speaker array but also in directions other than the directions of the directivity axes.

Preferably, the signal processing device obtains pieces of delay control information based on the pieces of propagation path information obtained by the path identifying device, and individually adjusts delay amounts of the plurality of audio signals according to the pieces of delay control information.

Preferably, the path identifying device finds a difference between a length of the propagation path to be followed by the sound output from each of the plurality of speakers and a length of a propagation path to be followed by a sound output from a specific speaker selected from among the plurality of speakers, as propagation path information related to the sound output from the speaker concerned.

More preferably, the path identifying device finds a linear distance between a specific point within a virtual image of the acoustic space and the each of the plurality of speakers and a linear distance between the specific point within the virtual image of the acoustic space and the specific speaker, and finds a difference between the linear distances as propagation path information related to the sound output from the speaker concerned.

Preferably, the signal processing device finds a delay time, obtained by dividing the difference between the linear distances obtained by the path identifying device by a sound speed, as delay control information related to a corresponding one of the plurality of audio signals, and adjusts a delay amount of the audio signal according to the delay control information.

Preferably, the signal processing device finds a difference between a phase of a sound output from each of the plurality of speakers upon arrival of the sound to the listening area and a phase of the sound output from a specific speaker selected from among the plurality of speakers upon arrival of the sound to the listening area, as the delay control information related to a corresponding one of the plurality of audio signals.

Preferably, the area setting device enables a user to specify a location of the listening area in the acoustic space.

More preferably, the area setting device enables the user to specify a center position of the listening area on a horizontal plane extending through the acoustic space.

Preferably, the area setting device enables a user to specify a size of the listening area.

More preferably, the area setting device enables the user to specify a radius of the listening area when the listening area is circular.

According to the above preferred forms, a listening area with a desired size can be set in the acoustic space.

Preferably, the area setting device enables a user to specify a location of the listening area in the acoustic space and a size of the listening area.

Preferably, the area setting device enables a user to specify a location of the listening area in the acoustic space and a shape of the listening area.

Preferably, as the propagation path indicated by the propagation path information becomes longer, the signal processing device identifies such window function information that makes a directivity of the sound output from the speaker corresponding to the propagation path information narrower.

More preferably, the signal processing device selects, as the window function information, a window function coefficient corresponding to one of a rectangular window, a Hanning window, a Hamming window, and a Gaussian window according to a length of the propagation path indicated by the propagation path information.

Preferably, as a size of the listening area becomes smaller, the signal processing device identifies such window function information that makes a directivity of the sound output from the speaker corresponding to the propagation path information narrower.

More preferably, the signal processing device selects, as the window function information, a window function coefficient corresponding to one of a rectangular window, a Hanning window, a Hamming window, and Gaussian window according to the size of the listening area.

According to the above preferred forms, the longer the propagation path is, or the broader the listening area is, the narrower the directivity given by a window function that is determined.

Preferably, the audio signal supply apparatus comprises a characteristic setting device that is used to set an acoustic characteristic of the acoustic space, and the signal processing device identifies the pieces of window function information according to the acoustic characteristic set by the characteristic setting device, the pieces of propagation path information obtained by the path identifying device, and the size of the listening area, and carries out the weighing on signal levels of the respective ones of the plurality of audio signals using the identified window function information to obtain the output signals.

More preferably, the characteristic setting device enables a user to set at least one of the size of the acoustic space, a shape of the acoustic space, a sound absorption coefficient of a sound reflective surface of the acoustic space, a sound reflection coefficient of the sound reflective surface of the acoustic space, and a sound wave attenuation constant of the acoustic space, as the acoustic characteristic.

Preferably, the signal processing device obtains pieces of delay control information on the plurality of audio signals according to the acoustic characteristic set by the characteristic setting device and the pieces of propagation path information obtained by the path identifying device, and individually adjusts delay amounts of the plurality of audio signals according to the pieces of delay control information.

According to the above preferred forms, with consideration given to acoustic characteristics of the acoustic space, directivities to give a desired range can be given to sound waves output from the respective speakers.

Preferably, the externally input audio signal includes right- and left-channel signals, and the acoustic space in which the audio signal supply apparatus is used is configured such that sounds output from the plurality of speakers are reflected on right and side walls to reach the listening area.

Alternatively, the externally input audio signal includes surround channel signals, and the acoustic space in which the audio signal supply apparatus is used is configured such that sounds output from the plurality of speakers are reflected on at least one of a right side wall, a left side wall, and a rear wall to reach the listening area.

Preferably, the plurality of speakers include surround wall speakers and surround rear speakers, and the signal processing device identifies such window function information that broadens a directivity of a sound output from each of the surround wall speakers and narrows a directivity of a sound output from each of the surround rear speakers.

According to the above preferred form, the directivity of sounds output from speakers corresponding to surround rear channels of which propagation paths are long can be narrowed, and on the other hand, the directivity of sounds output from speakers corresponding to surround wall channels of which propagation paths are short can be broadened.

The above and other objects, features, and advantages of the invention will become more apparent from the following detained description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
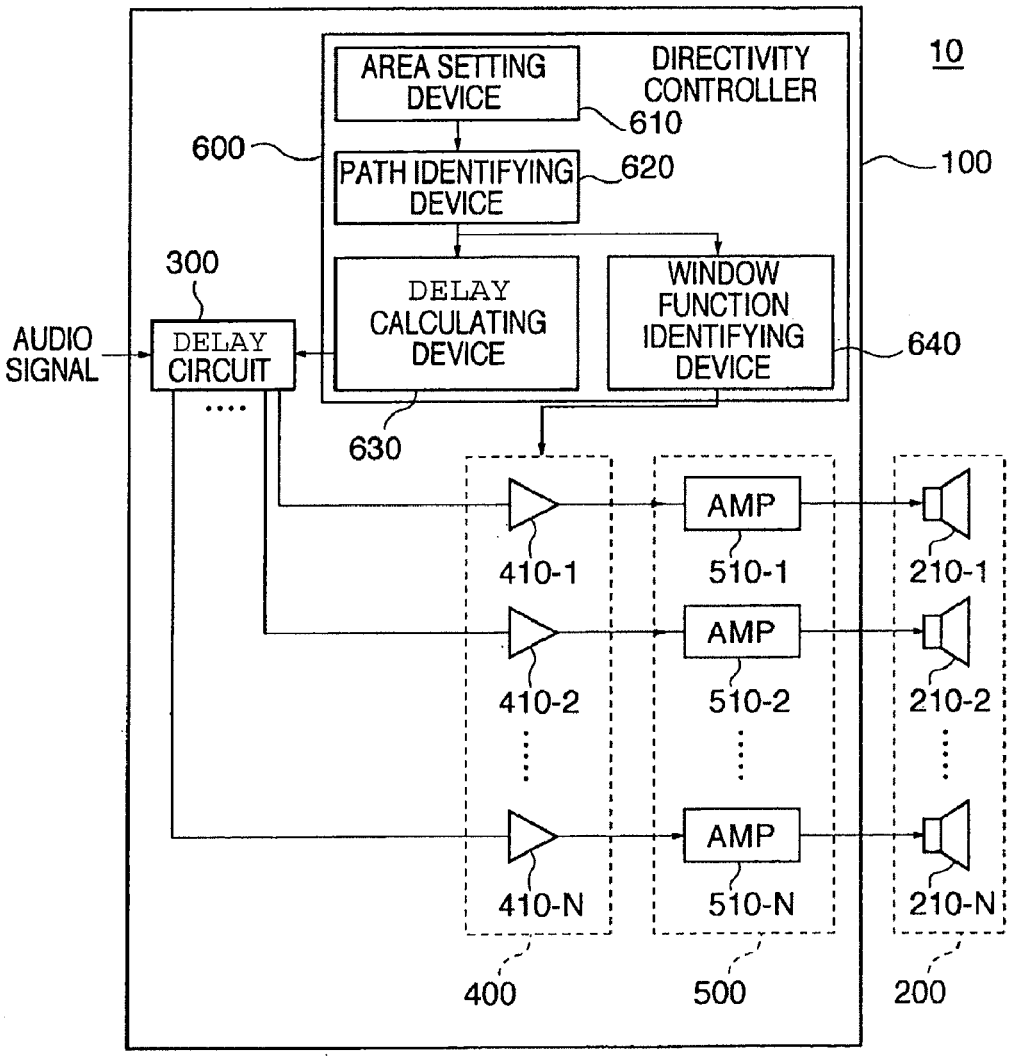
FIG. 1 is a block diagram showing the arrangement of an audio signal supply apparatus according to an embodiment of the present invention.

FIG. 1 is a block diagram showing an example of the arrangement of a speaker array system 10 including an audio signal supply apparatus 100 according to an embodiment of the present invention.

The audio signal supply apparatus 100 appearing in FIG. 1 causes an externally input audio signal comprised of, for example, right- and left-channel signals to branch into N audio signals corresponding in number to speaker units 210-*n* (n=1 to N) constituting a speaker array 200 and arranged, e.g., two-dimensionally. The audio signal supply apparatus 100 then carries out signal processing (i.e. adjustment of delays and signal levels) suitable for the audio signals and the speaker units 210-*n* on each of the respective audio signals and supplies the resultant audio signals to the respective speaker units 210-*n*. To this end, the audio signal supply apparatus 100 is equipped with a delay circuit 300, a weighting device 400, an amplifying device 500, and a directivity controller 600.

It should be noted that an A/D converter is generally provided in a preceding stage of the delay circuit 300, but description thereof is omitted for simplicity of explanation. Also, a D/A converter is generally provided in a preceding stage of the amplifying device 500 (i.e. a digital signal weighted by the weighting device 400 as will be described later is converted into an analog signal by the D/A converter and input to the amplifying device 500), but description thereof is omitted for simplicity of explanation.

The delay circuit 300 causes an externally input audio signal to branch into N audio signals or receives N audio signals branched from an externally input audio signal by a circuit provided in a preceding stage of the delay circuit 300. Then, in accordance with delay control information supplied from the directivity controller 600, the delay circuit 300 carries out delay processing on the N audio signals (i.e. audio signals to be supplied to the respective speaker units 210-*n*) to adjust the delay amounts of the respective N audio signals. The delay circuit 300 is comprised of, for example, N analog or digital filters each having a signal delaying function.

It should be noted that it is not indispensably necessary for the delay circuit 300 to cause an externally input audio signal to branch into N audio signals. Alternatively, an externally input audio signal may be branched into N audio signals in advance by means of a circuit, not shown, provided in the audio signal supply apparatus 100 and in a preceding stage of the delay circuit 300, or a circuit, not shown, provided outside the audio signal supply apparatus 100 and in a preceding stage of the delay circuit 300, and the N audio signals may be supplied to the delay circuit 300.

Figure 2:
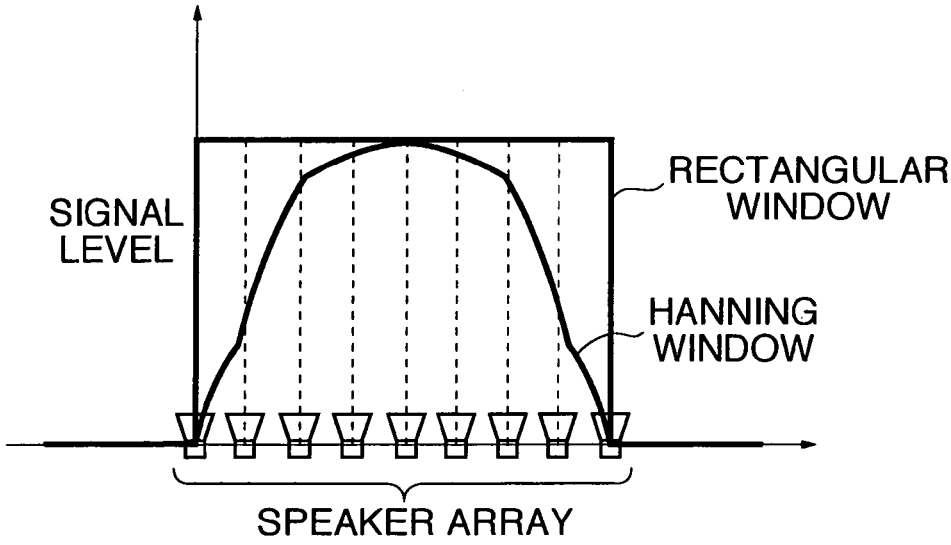
FIG. 2 is a diagram showing an example of a weighting process carried out by a weighting device of the audio signal supply apparatus.

The weighting device 400 is comprised of multipliers 410-*n* (n=1 to N) corresponding in number to the speaker units 210-*n*. The multipliers 410-*n* carry out weighting on the signal levels of delayed audio signals supplied from the delay circuit 300 (i.e. adjustment of the signal levels of respective audio signals). This will now be described in further detail. The multipliers 410-*n* adjust the signal levels of audio signals supplied to the multipliers 410-*n* according to window function information set by the directivity controller 600, descried in detail later, and output the audio signals of which signal levels have been adjusted to the amplifying device 500. Examples of the window function information include a window function coefficient indicative of a rectangular window, or a window function coefficient indicative of a Hanning window. In such a case, the weighting device 400 carries out weighting on audio signals by adjusting the signal levels of the respective audio signals to be supplied to the respective speaker units 210-*n* as shown in FIG. 2.

The amplifying device 500 is comprised of amplifiers 510-*n* (n=1 to N) corresponding in number to the speaker units 210-*n*. The amplifying device 500 amplifies the audio signals weighted by the weighting device 400 while maintaining the ratio of the signal levels of the respective audio signals. It goes without saying that when the audio signals weighted by the weighting device 400 have desirable signal levels, it is unnecessary to amplify the audio signals using the amplifying device 500.

As shown in FIG. 1, the directivity controller 600 includes an area setting device 610, a path identifying device 620, a delay calculating device 630, and a window function identifying device 640.

Figure 3:
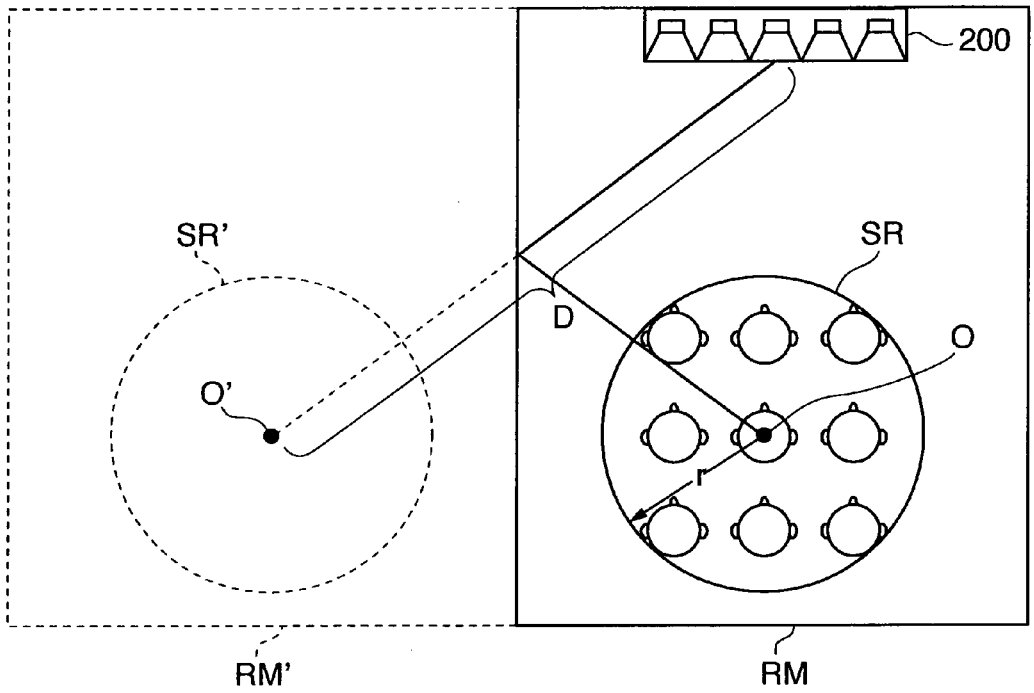
FIG. 3 is a diagram showing an example of a propagation path calculating process carried out by a path calculating device of the audio signal supply apparatus.

The area setting device 610 is for the user to set a listening area having a predetermined size in an acoustic space where the speaker array system 1 is set up. In the present embodiment, as shown in FIG. 3, the user sets the coordinates of a center position O of a circular listening area SR on a horizontal plane passing through an acoustic space RM, thereby setting the position of the listening area SR in the acoustic space RM. Here, the radius r of the circular listening area SR is set to a fixed value in advance, and the listening area SR has a predetermined size corresponding to the fixed radius r.

With respect to each of the speaker units 210-*n*, the path identifying device 620 identifies propagation path information related to a propagation path to be followed by a sound wave output from the speaker unit 210-*n* until it reaches the listening area SR.

Specifically, as shown in FIG. 3, it is assumed that there is a virtual image RM' of the acoustic space RM, which is symmetrical to the acoustic space RM with respect to the left side wall of the acoustic space RM. The path identifying device 620 finds a straight line connecting the coordinates of a specific point (in the present invention, a virtual image SR's center position O') within a virtual image SR' of the listening area SR on a horizontal plane passing through the acoustic space RM and the coordinates of each speaker unit 210-*n* and identifies the straight line as a propagation path to be followed by a sound wave output from each speaker unit 210-*n*.

Further, the path identifying device 620 finds a linear distance between a specific speaker unit (for example, a speaker unit located at the center of the speaker array 200) selected from among the plurality of speaker units constituting the speaker array 200 and the center position O' of the listening area's virtual image SR' as a reference, finds a linear distance between each speaker unit and the center position O' of the listening area's virtual image SR', and finds a difference between these linear distances as propagation path information on each speaker unit.

The delay calculating device 630 determines, as a delay amount, a delay time by dividing the difference between the linear distances (i.e. the relative linear distance or relative propagation path length) determined by the path identifying device 620 by the sound speed, and sets delay control information indicative of the delay amount in the delay circuit 300. As described earlier, the delay circuit 300 adjusts the delay amounts of audio signals according to delay control information.

In the present embodiment, the case has been described in which the delay calculating device 630 calculates delay times according to differences in the distances of propagation paths (i.e. the relative lengths of propagation paths) found for the respective speaker units 210-*n* as delay amounts and sets delay control information indicative of the delay amounts in the delay circuit 300. Alternatively, however, the delay calculating device 630 may calculate, as delay amounts, phase differences (the relative phases of sounds upon arrival to the listening area) according to the differences in distance (the relative lengths of propagation paths of sounds from the respective speakers) and set delay control information indicative of the phase differences in the delay circuit 300.

Also, although in the present embodiment, the case has been described in which the relative length of each propagation path (difference in length) is calculated based on the linear distance between the specific speaker unit located at the center of the speaker array and the center position O' of the listening area's virtual image SR', it is a matter of course that the relative length of each propagation path may be calculated based on the linear distance between another specific speaker unit, such as one located at the right or left end of the speaker array, and the center position O' of the virtual image SR'.

The window function identifying device 640 identifies window function coefficients indicative of weights to be given to the signal levels of the respective audio signals to be supplied to the respective speaker units 210-*n* according to the differences in the distances of the propagation paths identified for the respective speaker units 210-*n* by the path identifying device 620 and the size of the listening area SR, generates window function information indicative of the window function coefficients, and sets the generated window function information in the respective multipliers 410-*n*.

This will now be described in further detail. The window function identifying device 640 includes a storage section implemented by, for example, a ROM (read only memory), which stores threshold value data indicative of a threshold value L related to the distances of propagation paths to be followed by sounds output from the respective speaker units, a first window function coefficient indicative of a rectangular window, and a second window function coefficient indicative of a Hanning window. When the distance of a propagation path identified by the path identifying device 620 is greater than the threshold value L, the window function identifying device 640 reads out the first window function coefficient and sets it in the corresponding multiplier 410-*n*. On the other hand, when the distance of a propagation path identified by the path identifying device 620 is equal to or smaller than the threshold value L, the window function identifying device 640 reads out the second window function coefficient and sets it in the corresponding multiplier 410-*n*.

Here, the Hanning window is to widen the directivity of sound as compared with the case where the rectangular window is used. To be more specific, the Hanning window is to give a wide directivity covering the entire listening area having the predetermined size (that is, such a directivity that in the listening area, sound is heard at the same volume at any location, whereas outside the listening area, the volume sharply decreases as the distance from the listening area increases) to a sound output from each speaker unit, even if the distance of the propagation path of the sound is short. In the present embodiment, since the window function coefficient indicative of the Hanning window is stored in advance in the storage section as the second window function coefficient for use in the case where the propagation path distance is less than the threshold value L, a wide directivity covering the entire listening area can be given to a sound wave output from a speaker unit 210 and following a propagation path shorter than the threshold value L.

Figure 4:
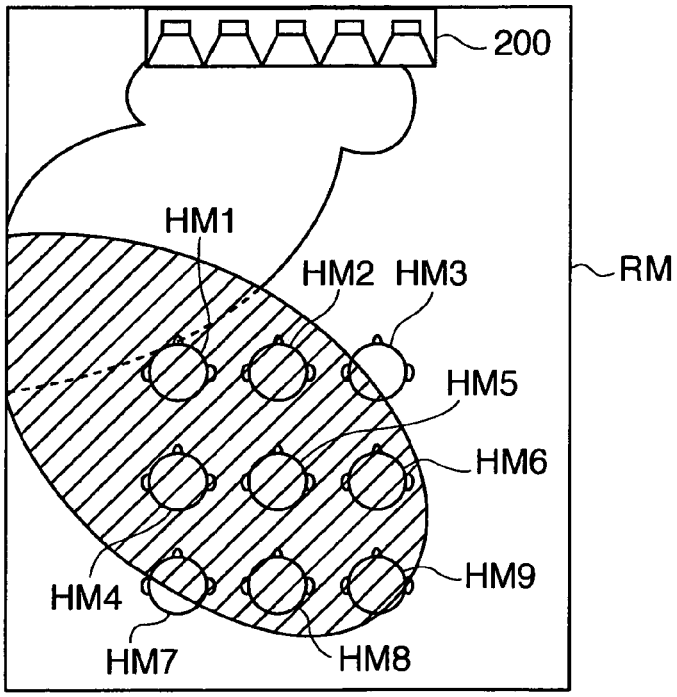
FIG. 4 is a diagram useful in explaining an example of how the audio signal supply apparatus is used.

With this arrangement, the audio signal supply apparatus 100 according to the present embodiment can, for example, give a wide directivity covering the entire listening area to a sound wave that is output from a speaker unit 210-*n* and that follows a propagation path shorter than the threshold value L until it reaches the listening area set by the area setting device 610 after reflected on the wall of the acoustic space RM, as shown in FIG. 4. That is, the same effects can be obtained as in the case where the above-mentioned diffusion plate RB is placed at the location at which sound is reflected on the wall of the acoustic space RM. Thus, the audio signal supply apparatus 100 according to the present embodiment makes it possible to advantageously broaden the area where satisfactory localization of sound images reproduced by the speaker array 200 can be obtained in directions other than the directions of directivity axes of acoustic beams output from the speaker array 200 without the need to take architectural measures such as placement of a diffusion plate at the location at which propagation paths intersect the wall of the acoustic space (i.e. the location at which sound waves following the propagation paths are reflected).

It should be understood that the present invention is not limited to the embodiment described above, but various changes in or to the above described embodiment may be possible without departing from the spirits of the present invention, including changes as described below.

First, a description will be given of a first modification of the present invention.

In the above described embodiment, a circular listening area having a fixed radius and size is set at an arbitrary position in an acoustic space by setting the center position of the listening area using the area setting device 610, and window function information is set according to the distances of propagation paths to be followed by sounds output from respective speaker units. On the other hand, in the present modification, it is possible to set not only the position of a listening area but also the size and shape of the listening area, and it is also possible to set window function information according to not only the distances of propagation paths but also the size and shape of the listening area.

To this end, in the present modification, the user sets parameters indicative of the center position of a listening area and the size of the listening area (e.g. the radius of the listening area when it is circular) and parameters indicative of the shape of the listening area (e.g. a parameter indicative of an equation of a curve or straight line representative of the periphery of the listening area) using the area setting device 610. Also, a threshold value related to the size of the listening area as well as a threshold value related to the distances of propagation paths to be followed by sounds until they reach the listening area is written in advance in the above-mentioned storage section. The window function identifying device 640 compares the distances of propagation paths identified by the path identifying device 620 and the size of the listening area indicated by the parameters set by the area setting device 610 with the threshold values written in the storage section of the window function identifying device 640 to thereby identify a window function coefficient.

Specifically, in the present modification, when a listening area having an arbitrary size and/or shape is set using the area setting device 610, a window function to give a wide directivity covering the entire listening area is identified, with consideration given to the size and/or shape of the listening area as well as the distances of propagation paths to be followed by sound waves output from the respective speaker units 210-*n* until they reach the listening area.

In the above described way, a listening area with an arbitrary size and/or shape can be set at an arbitrary position in an acoustic space.

Next, a description will be given of a second modification of the present invention.

Figure 9:
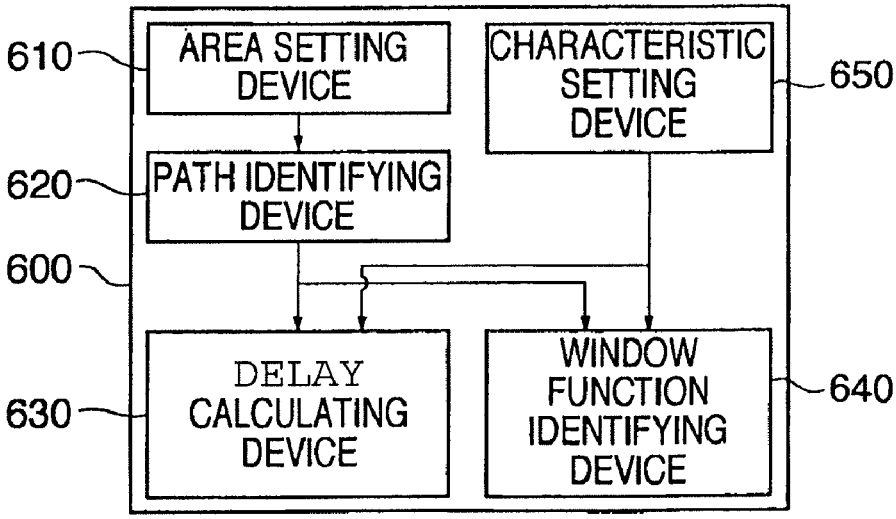
FIG. 9 is a block diagram showing a directivity controller of an audio signal supply apparatus according to another modification of the present invention.

This modification has been devised with consideration given to the dependency of propagation characteristics of sound waves output from the respective speaker units 210-*n*, such as the attenuation rates of sound waves, on acoustic characteristics of an acoustic space as well. Thus, the directivity controller 600 of this modification is provided with a characteristic setting device (denoted by reference numeral 650 in FIG. 9) that is used to set parameters indicative of acoustic characteristics of an acoustic space (parameters indicative of the size and shape of the acoustic space, the sound absorption coefficient and sound reflection coefficient of a sound reflective surface of the acoustic space, and sound wave attenuation constant of the acoustic space). The above-mentioned window function and the delay amounts of respective audio signals are identified with consideration given to the acoustic characteristics set by the user using the characteristic setting device 650. To this end, threshold values related to the acoustic characteristics are written in advance in the storage section of the window function identifying device 640, and the window function identifying device 640 compares the parameters set by the characteristic setting device 650 and the threshold values with each other to identify a window function. This also applies to the delay amounts.

Next, a description will be given of a third modification of the present invention.

In the above described embodiment, the distances of propagation paths to be followed by sound waves output from the respective speaker unit 210-*n* until they reach a listening area set by the area setting device 610 and the predetermined threshold value L are compared with each other, and one of the two types of window functions, i.e. the rectangular window and the Hanning window is selectively used according to the comparison result.

On the other hand, in the present modification, a plurality of threshold values related to the distances of the propagation paths are set in advance, and any of three or more types of window functions such as a rectangular window, a Hanning window, a Hamming window, and a Gaussian window is selectively used according to the comparison result. It should be noted that as is the case with the first modification, the window functions may be selectively used according to the size of a listening area even when the distances of propagation paths are the same. The point is that among the three or more types of window functions, a window function to give such a directivity as to cause the wave front of a sound wave output from each speaker unit 210-*n* to cover the entire listening area to the sound wave is selectively set according to the size and shape of the listening area and the distance of a propagation path followed by the sound wave until it reaches the listening area.

Next, a description will be given of a fourth modification of the present invention.

In the above described embodiment, the window functions are selectively used according to the distance of a propagation path followed by a sound wave output from each speaker units 210-*n* until it reaches a listening area set by the area setting device 610. On the other hand, in the present modification, window functions are selectively used for surround wall channels and surround rear channels. Specifically, a window function to give a wide directivity is set for surround wall channels, and a window function to give a narrow directivity is set for surround rear channels for the reasons described below.

Figure 5:
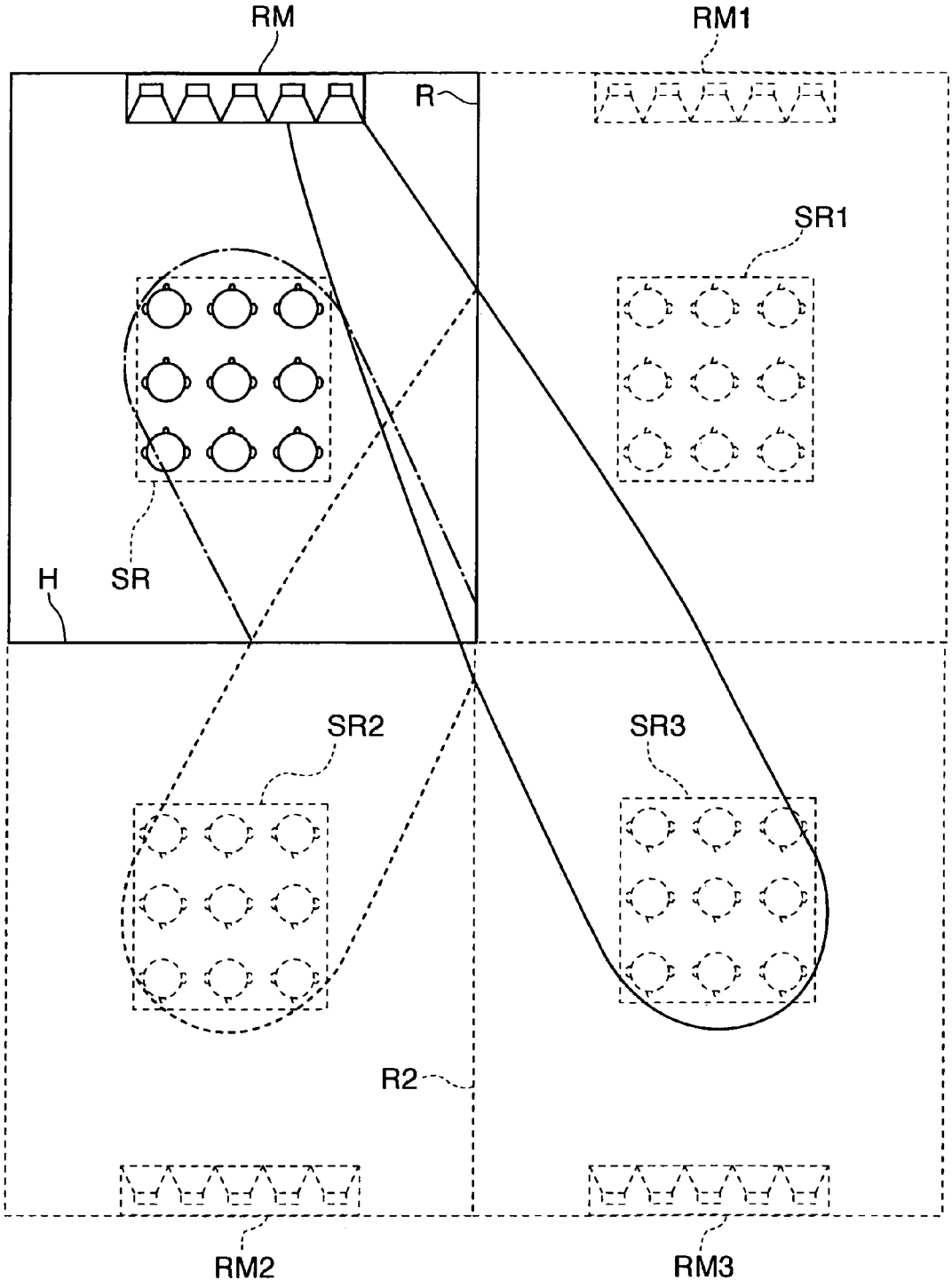
FIG. 5 is a diagram showing an example of propagation paths of sound from a rear surround system according to a modification of the present invention.
Figure 6:
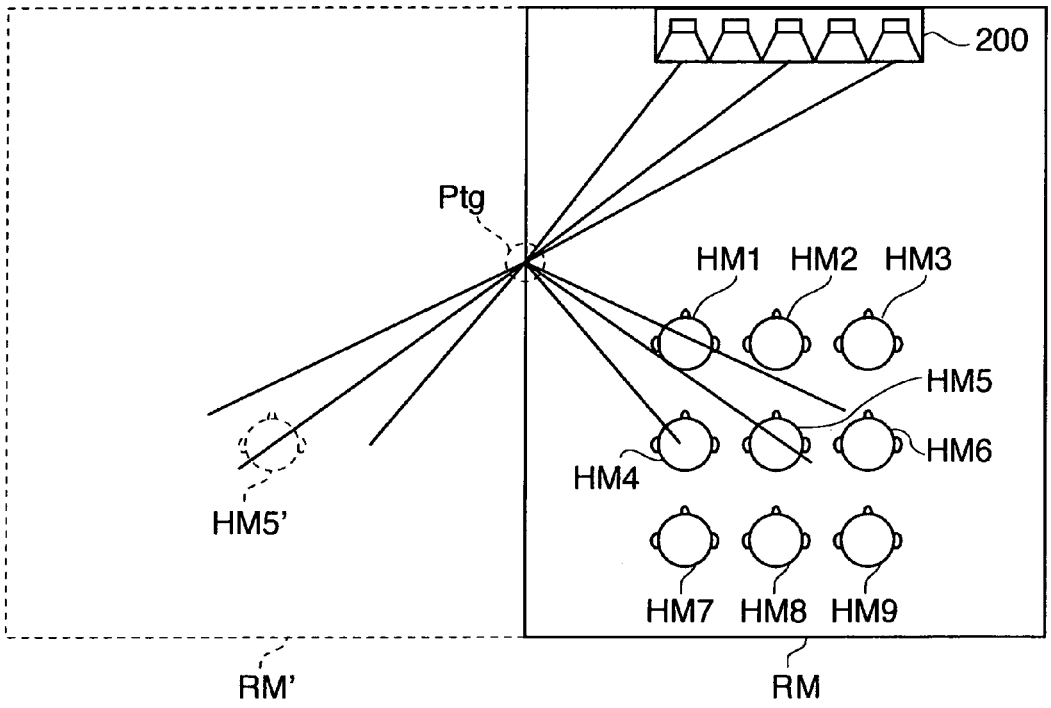
FIG. 6 is a diagram useful in explaining an example of the prior art in which a speaker array is used to form a sound field.
Figure 7:
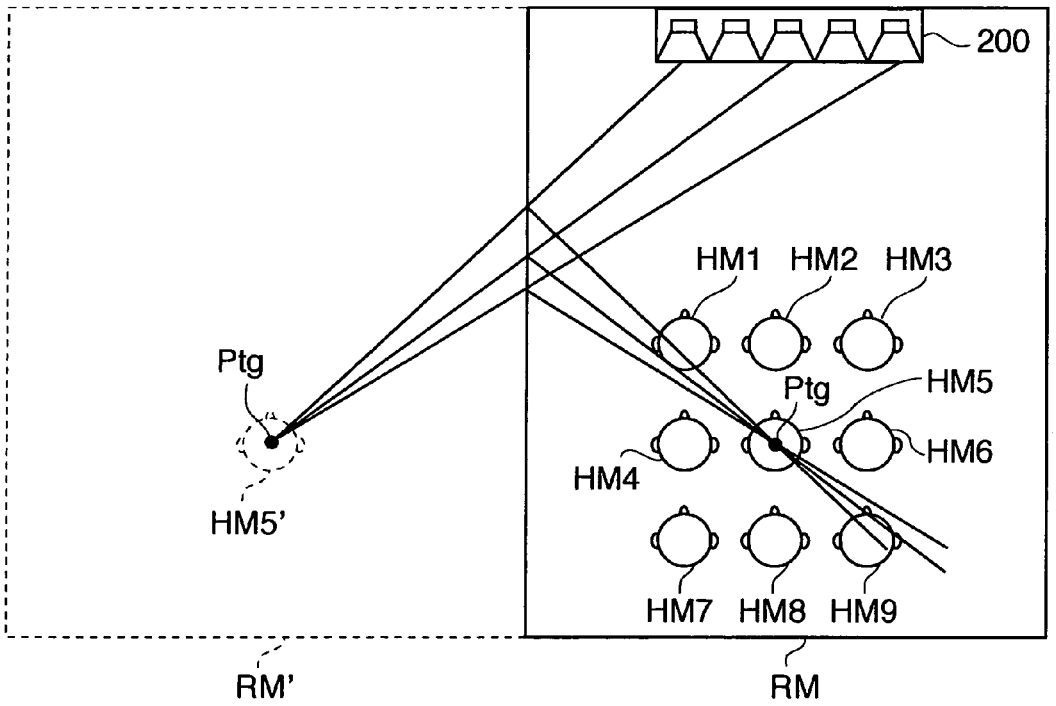
FIG. 7 is a diagram useful in explaining a prior art which improves localization of virtual sound images.
Figure 8:
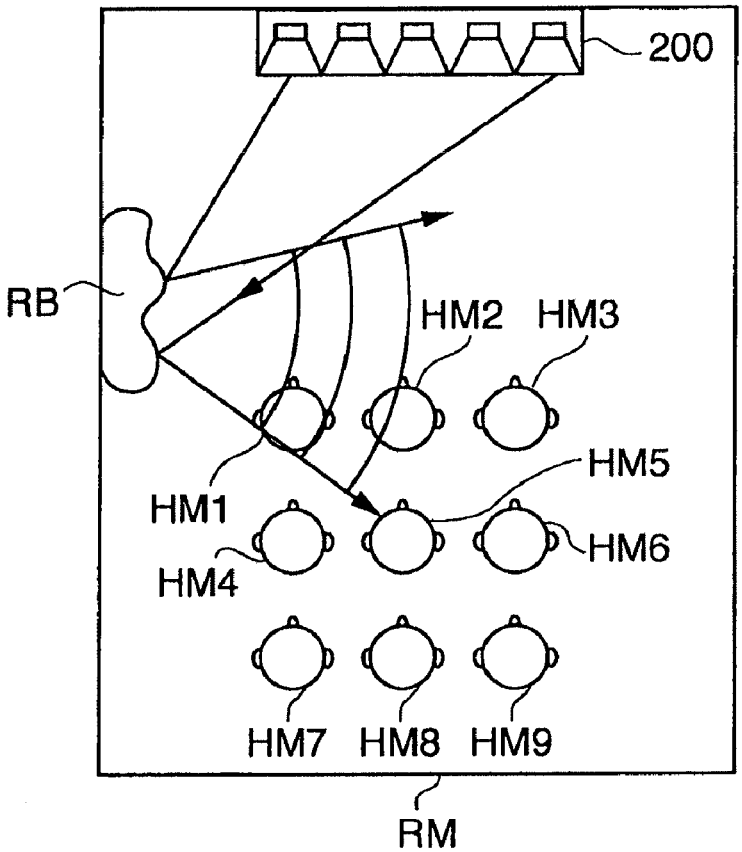
FIG. 8 is a diagram useful in explaining how a sound field is formed using a diffusion plate RB.

FIG. 5 is a diagram showing an example of propagation paths followed by sound waves output from speakers corresponding to surround rear channels when a window function to give a narrow directivity is set for these channels. It should be noted that, as for propagation paths followed by sounds output from speakers corresponding to surround wall channels, they are substantially identical with those appearing in FIG. 4, and therefore detailed description thereof is omitted.

In FIG. 5, RM1 denotes a virtual image of an acoustic space RM, which is symmetrical to the acoustic space RM with respect to a right wall R of the acoustic space RM; RM2 denotes another virtual image of the acoustic space RM, which is symmetrical to the acoustic space RM with respect to a rear wall H of the acoustic space RM; and RM3 denotes still another virtual image of the acoustic space RM, which is symmetrical to the virtual image RM2 with respect to an imaginary wall R2 of the virtual image RM2 of the acoustic space RM. Symbols SR1, SR2, and SR3 denote virtual images of a listening area SR.

As shown in FIG. 5, the propagation paths followed by sound waves output from speakers corresponding to surround rear channels (in the illustrated example, a speaker at the rightmost end and a speaker adjacent to the rightmost speaker as viewed from front, which are sometimes referred to as rear channel speakers hereinafter) are obtained by finding a straight line connecting the center of the listening area's virtual image SR3 and the rear channel speakers (in the illustrated example, the center of the two speakers). Specifically, sound waves output from rear channel speakers are reflected on the wall R of the acoustic space RM, and reflected waves thereof are reflected on the wall H of the acoustic space RM and reach the listening area SR.

As described above, sound waves output from speakers corresponding to surround rear channels are generally reflected a plurality of times before they reach the listening area SR, and hence the propagation paths followed by the sound waves are generally longer than those followed by sound waves output from speakers corresponding to surround wall channels.

For this reason, as for sound waves output from speakers corresponding to surround rear channels, the wave front thereof becomes excessively broad so that satisfactory localization of sound images cannot be obtained in the listening area unless directivities of such sound waves are set to be narrow in advance.

Also, as is clear from comparison between FIGS. 4 and 5, the reflection angles of sound waves output from speakers corresponding to surround rear channels are generally smaller than those of sound waves output from speakers corresponding to surround wall channels. For this reason, if directivities of sound waves output from speakers corresponding to surround rear channels are set to be wide, there is a high possibility that sound waves output from those speakers and primary reflection waves thereof cross the listening area SR. It goes without saying that if sound waves output from those speakers and primary reflection waves thereof cross the listening area SR, this adversely affects a sound field formed in the listening area SR.

For the reasons described above, in the present modification, directivities of sound waves output from speakers corresponding to surround rear channels are set to be narrow in advance so as not to adversely affect a sound field formed in the listening area SR.

What is claimed is:

1. An audio signal supply apparatus comprising:

an area setting device that is used to specify a listening area in an acoustic space;

a path identifying device that identifies propagation paths to be followed by sounds output from respective ones of a plurality of speakers constituting a speaker array until the sounds reach the listening area and obtains pieces of propagation path information respectively related to the propagation paths; and a signal processing device that identifies pieces of window function information that give such directivities as to cover the entire listening area to the sounds output from the respective ones of the plurality of speakers based on the pieces of propagation path information and a size of the listening area, wherein said signal processing device carries out weighting on respective signal levels of a plurality of audio signals branched from an externally input audio signal and corresponding in number to the plurality of speakers by using the pieces of window function information to obtain output signals that are to be supplied to the respective ones of the plurality of speakers.

2. An audio signal supply apparatus according to claim 1, wherein said signal processing device obtains pieces of delay control information based on the pieces of propagation path information obtained by said path identifying device, and individually adjusts delay amounts of the plurality of audio signals according to the pieces of delay control information.

3. An audio signal supply apparatus according to claim 1, wherein said path identifying device finds a difference between a length of the propagation path to be followed by the sound output from each of the plurality of speakers and a length of a propagation path to be followed by a sound output from a specific speaker selected from among the plurality of speakers, as propagation path information related to the sound output from the speaker concerned.

4. An audio signal supply apparatus according to claim 3, wherein said path identifying device finds a linear distance between a specific point within a virtual image of the acoustic space and said each of the plurality of speakers and a linear distance between the specific point within the virtual image of the acoustic space and the specific speaker, and finds a difference between the linear distances as the propagation path information related to the sound output from the speaker concerned.

5. An audio signal supply apparatus according to claim 4, wherein said signal processing device finds a delay time, obtained by dividing the difference between the linear distances obtained by said path identifying device by a sound speed, as delay control information related to a corresponding one of the plurality of audio signals, and adjusts a delay amount of the audio signal according to the delay control information.

6. An audio signal supply apparatus according to claim 2, wherein said signal processing device finds a difference between a phase of a sound output from each of the plurality of speakers upon arrival of the sound to the listening area and a phase of the sound output from a specific speaker selected from among the plurality of speakers upon arrival of the sound to the listening area, as the delay control information related to a corresponding one of the plurality of audio signals.

7. An audio signal supply apparatus according to claim 1, wherein said area setting device enables a user to specify a location of the listening area in the acoustic space.

8. An audio signal supply apparatus according to claim 7, wherein said area setting device enables the user to specify a center position of the listening area on a horizontal plane extending through the acoustic space.

9. An audio signal supply apparatus according to claim 1, wherein said area setting device enables a user to specify a size of the listening area.

10. An audio signal supply apparatus according to claim 9, wherein said area setting device enables the user to specify a radius of the listening area when the listening area is circular.

11. An audio signal supply apparatus according to claim 1, wherein said area setting device enables a user to specify a location of the listening area in the acoustic space and a size of the listening area.

12. An audio signal supply apparatus according to claim 1, wherein said area setting device enables a user to specify a location of the listening area in the acoustic space and a shape of the listening area.

13. An audio signal supply apparatus according to claim 1, wherein as the propagation path indicated by the propagation path information becomes longer, said signal processing device identifies such window function information that makes a directivity of the sound output from the speaker corresponding to the propagation path information narrower.

14. An audio signal supply apparatus according to claim 13, wherein said signal processing device selects, as the window function information, a window function coefficient corresponding to one of a rectangular window, a Hanning window, a Hamming window, and a Gaussian window according to a length of the propagation path indicated by the propagation path information.

15. An audio signal supply apparatus according to claim 1, wherein as a size of the listening area becomes smaller, said signal processing device identifies such window function information that makes a directivity of the sound output from the speaker corresponding to the propagation path information narrower.

16. An audio signal supply apparatus according to claim 15, wherein said signal processing device selects, as the window function information, a window function coefficient corresponding to one of a rectangular window, a Hanning window, a Hamming window, and Gaussian window according to the size of the listening area.

17. An audio signal supply apparatus according to claim 1, comprising a characteristic setting device that is used to set an acoustic characteristic of the acoustic space, and wherein said signal processing device identifies the pieces of window function information according to the acoustic characteristic set by said characteristic setting device, the pieces of propagation path information obtained by said path identifying device, and the size of the listening area, and carries out the weighing on signal levels of the respective ones of the plurality of audio signals using the identified window function information to obtain the output signals.

18. An audio signal supply apparatus according to claim 17, wherein said characteristic setting device enables a user to set at least one of the size of the acoustic space, a shape of the acoustic space, a sound absorption coefficient of a sound reflective surface of the acoustic space, a sound reflection coefficient of the sound reflective surface of the acoustic space, and a sound wave attenuation constant of the acoustic space, as the acoustic characteristic.

19. An audio signal supply apparatus according to claim 17, wherein said signal processing device obtains pieces of delay control information on the plurality of audio signals according to the acoustic characteristic set by said characteristic setting device and the pieces of propagation path information obtained by said path identifying device, and individually adjusts delay amounts of the plurality of audio signals according to the pieces of delay control information.

20. An audio signal supply apparatus according to claim 1, wherein the externally input audio signal includes right- and left-channel signals, and the acoustic space in which the audio signal supply apparatus is used is configured such that sounds output from the plurality of speakers are reflected on right and side walls to reach the listening area.

21. An audio signal supply apparatus according to claim 1, wherein the externally input audio signal includes surround channel signals, and the acoustic space in which the audio signal supply apparatus is used is configured such that sounds output from the plurality of speakers are reflected on at least one of a right side wall, a left side wall, and a rear wall to reach the listening area.

22. An audio signal supply apparatus according to claim 1, wherein the plurality of speakers include surround wall speakers and surround rear speakers, and said signal processing device identifies such window function information that broadens a directivity of a sound output from each of the surround wall speakers and narrows a directivity of a sound output from each of the surround rear speakers.

* * * * *